US005831503A

United States Patent [19]

Beck et al.

[11] Patent Number: 5,831,503

[45] Date of Patent: Nov. 3, 1998

[54] TRIP DISABLING MECHANISM FOR ELECTRICAL SWITCHING APPARATUS

[75] Inventors: H. Richard Beck, Moon Township; Kenneth M. Fischer, Union Township, both of Pa.

[73] Assignee: Eaton Corporation, Cleveland, Ohio

[21] Appl. No.: 828,830

[22] Filed: Mar. 19, 1997

[51] Int. Cl.[6] ..... H01H 9/00

[52] U.S. Cl. ..... 335/172; 335/167

[58] Field of Search ..... 335/23–25, 35, 335/167, 176; 200/189.94, 43.14, 43.11

[56] References Cited

U.S. PATENT DOCUMENTS

| | | | |
|---|---|---|---|
| 4,603,313 | 7/1986 | Shimp et al. | 335/172 |
| 4,827,369 | 5/1989 | Saletta et al. | 361/96 |
| 4,887,057 | 12/1989 | Gula et al. | 335/190 |
| 5,200,724 | 4/1993 | Gula et al. | 335/166 |
| 5,341,191 | 8/1994 | Crookston et al. | 335/16 |
| 5,577,599 | 11/1996 | Turek et al. | 200/43.14 |
| 5,609,244 | 3/1997 | Reiter | 200/41.11 |

*Primary Examiner*—Lincoln Donovan
*Attorney, Agent, or Firm*—Martin J. Moran

[57] ABSTRACT

A circuit breaker includes a molded housing and separable contacts for movement between a closed position and an open position. An operating mechanism moves the separable contacts between their closed and open positions. A trip mechanism includes a trip bar which rotates to trip the operating mechanism from a first position to a second position corresponding to the open position of the separable contacts. A mechanical mechanism includes an interlock cam which selectively prevents the trip bar from rotating to trip the operating mechanism.

21 Claims, 5 Drawing Sheets

FIG. 7
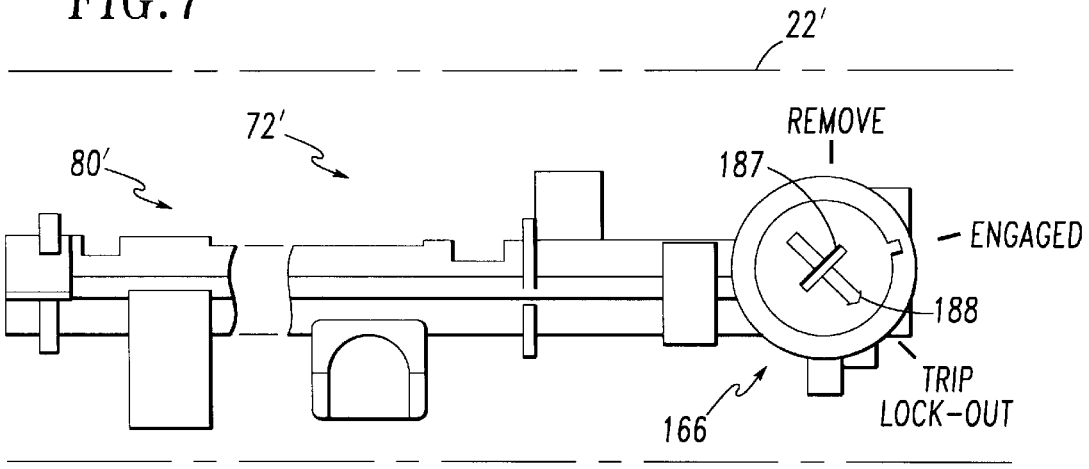
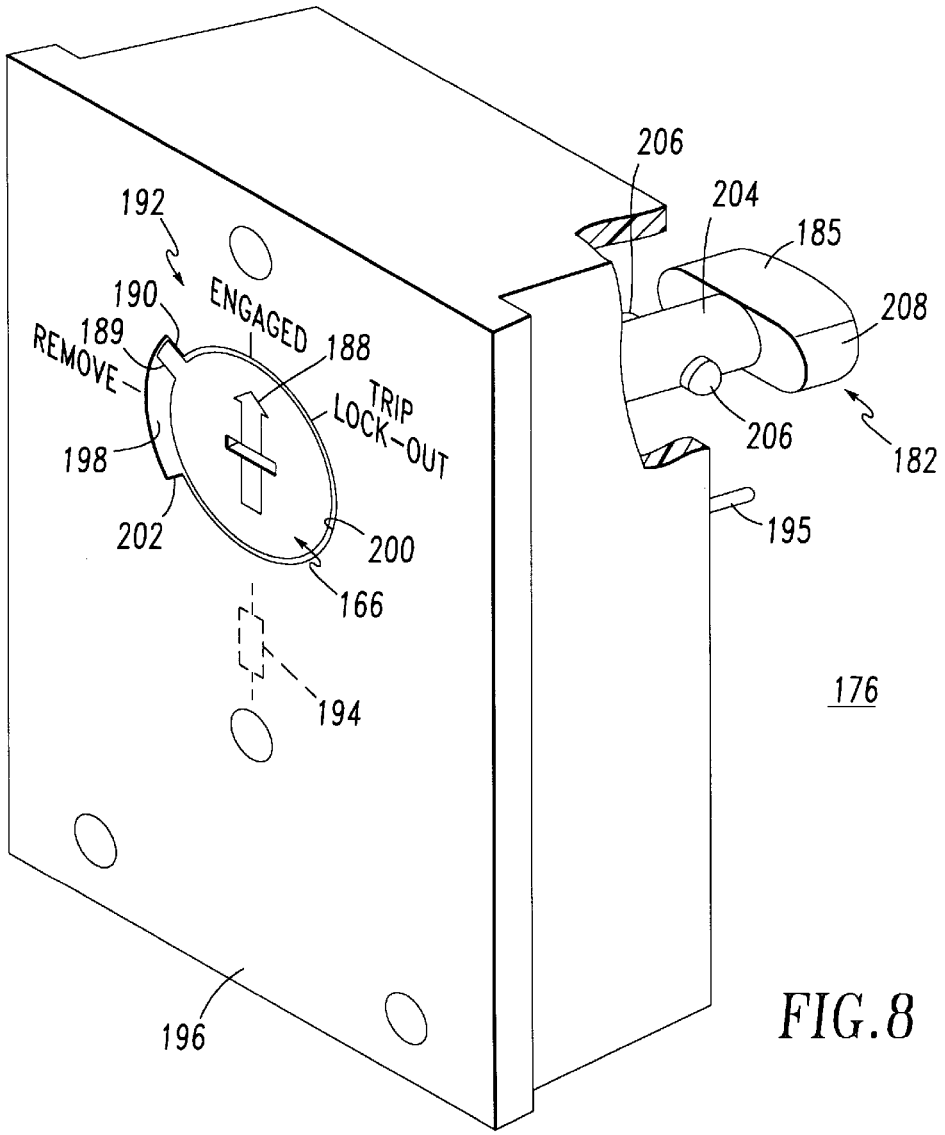
FIG. 8

TRIP DISABLING MECHANISM FOR ELECTRICAL SWITCHING APPARATUS

BACKGROUND OF THE INVENTION

1. Field of the Invention

This invention is directed to an electrical switching apparatus and, more particularly, to a circuit interrupter, such as a circuit breaker, including a trip mechanism, and, most particularly, to a circuit breaker including a mechanism for disabling an automatic or manual trip mechanism.

2. Background Information

Electrical switching devices include, for example, circuit switching devices and circuit interrupters such as circuit breakers, contactors, motor starters, motor controllers and other load controllers. Circuit breakers are generally old and well known in the art. Examples of circuit breakers are disclosed in U.S. Pat. Nos. 4,606,313; 4,887,057; 5,200,724; and 5,341,191. Such circuit breakers are used to protect electrical circuitry from damage due to an overcurrent condition, such as an overload condition or a relatively high level short circuit condition.

Molded case circuit breakers include a pair of separable contacts per phase which may be operated either manually by way of a handle disposed on the outside of the case or automatically in response to an overcurrent condition. Typically, such circuit breakers include an operating mechanism which is designed to rapidly open and close the separable contacts.

Some circuit breakers include a pivoting operating handle, which projects through an opening formed in the circuit breaker housing, for manual operation. The handle may assume two or more positions during normal operation of the circuit breaker. In an on position, the handle is positioned at one end of its permissible travel. When the operating handle is moved to this position, and the circuit breaker is not tripped, the separable contacts close, thereby allowing electrical current to flow from a current source to a load. Near or at the opposite end of travel of the handle is an off position. When the handle is moved to that position, the separable contacts open, thereby preventing current from flowing through the circuit breaker to the load.

Circuit breakers include a trip mechanism which senses overcurrent conditions in an automatic mode of operation. The trip mechanism causes a trigger mechanism to release the operating mechanism thereby tripping open the separable contacts. Some types of circuit breakers include a thermal-magnetic trip unit which interrupts current flow in two or more modes of operation. The thermal-magnetic trip unit generally senses overload currents of up to about five to six times normal rated current as well as short circuit currents of greater than about ten times normal rated current. Other types of circuit breakers include an electronic trip unit for automatically interrupting the current flow.

Some trip units include a removable rating plug and/or a manual push-to-trip pushbutton. The rating plug typically provides a user selectable rated current value associated with the load powered through the circuit breaker. Whenever the rating plug is removed, a trip bar of the trip mechanism is held in its tripped position to trip the circuit breaker and prevent the separable contacts from closing. The manual pushbutton is employed to rotate the trip bar and, hence, manually trip the circuit breaker under emergency or test circumstances. See U.S. Pat. Nos. 4,603,313; and 5,341,191.

Although it is very unsafe to do so, it is known to employ a mechanism, such as a coin, to short circuit and, hence, defeat the circuit interruption function of a conventional fuse.

It is also known to lock a circuit breaker handle in the on position to prevent an unauthorized user from switching the handle to the off position, although this still allows the trip mechanism to trip open the separable contacts of the circuit breaker.

U.S. Pat. No. 4,827,369 discloses the use of zone interlocks between upstream and downstream circuit interrupters to adjust the timing of short delay and ground fault protection in the upstream devices. For example, if a short delay current threshold is exceeded in the downstream device, it sends a zone interlock signal to the upstream device to indicate that a short delay fault condition was identified. If the short delay current threshold is exceeded in the upstream device, and the zone interlock signal is not received from the downstream device, then a short delay trip is rapidly initiated by the upstream device on the second consecutive recognition of the threshold being exceeded. Otherwise, if the threshold is exceeded and the zone interlock signal is received, then a time delayed portion, either an $I^2t$ or fixed time type, of the short delay routine is executed by the upstream device. Ground fault protection is implemented in a similar manner.

There is, however, room for improvement in the circuit interruption function of electrical switching devices.

SUMMARY OF THE INVENTION

This need and others are satisfied by the invention, which is directed to an electrical switching apparatus. This apparatus includes a mechanism for selectively disabling its trip mechanism. In this manner, a user may selectively disable the trip mechanism under emergency, hazardous or other critical situations, in which, for example, the risk of loss of life or some other unacceptable consequence caused by tripping and the subsequent loss of power is greater than the risk of fire or some other power circuit damage caused by not tripping.

The electrical switching apparatus comprises a housing; separable contact means for movement between a closed position and an open position; operating means for moving the separable contact means between the closed position and the open position thereof, with the operating means having a first position and a second position corresponding to the open position of the separable contact means; trip means for tripping the operating means to the second position thereof to move the separable contact means to the open position thereof; and means for selectively disabling the trip means from tripping the operating means to the second position thereof.

BRIEF DESCRIPTION OF THE DRAWINGS

A full understanding of the invention can be gained from the following description of the preferred embodiment when read in conjunction with the accompanying drawings in which:

FIG. 7 is a plan view of the trip bar and pushbutton of FIG. 6; and

FIG. 8 is an isometric view of a rating plug assembly employing the pushbutton and interlock cam of FIG. 2.

DESCRIPTION OF THE PREFERRED EMBODIMENT

Figure 1:
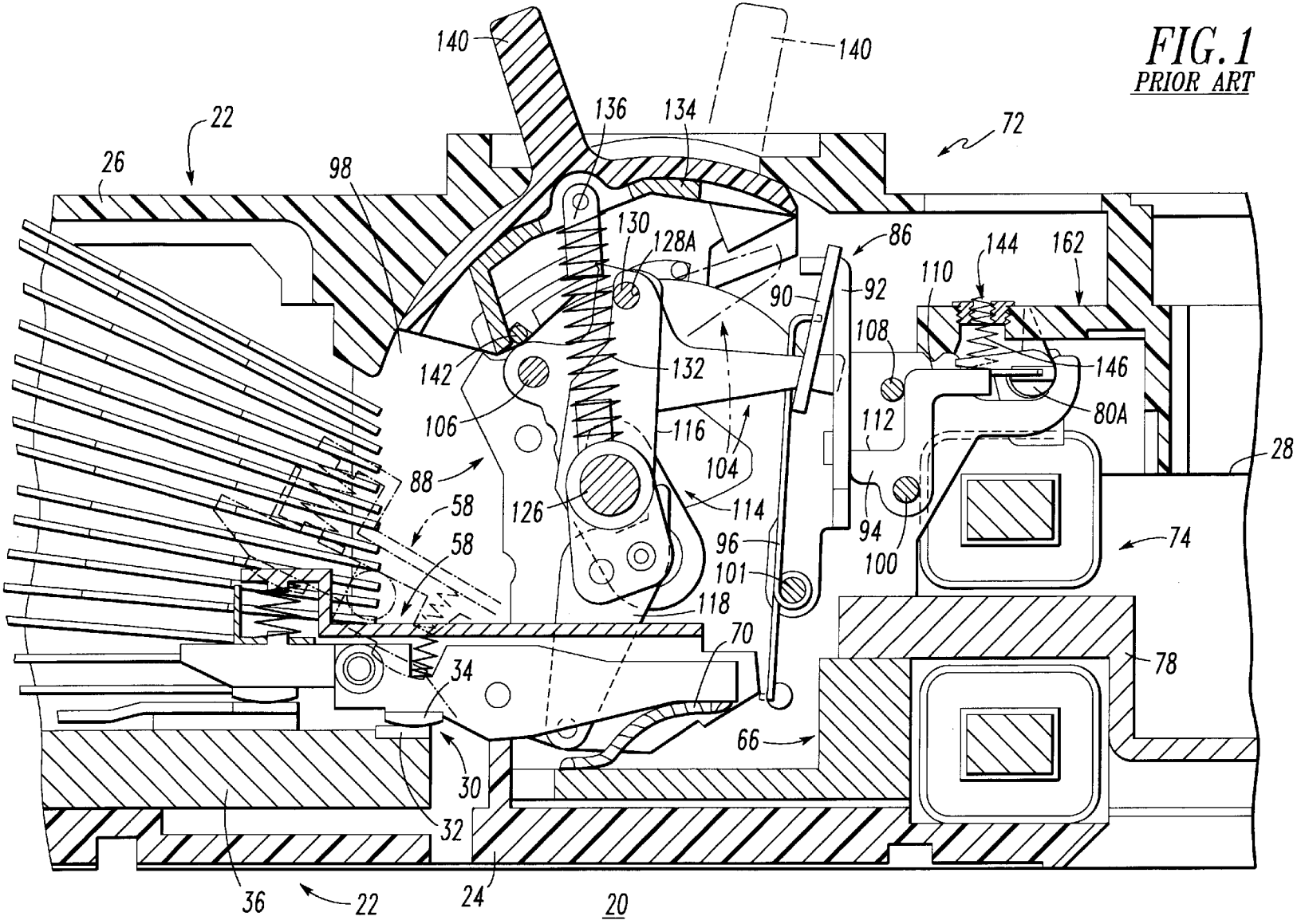
FIG. 1 PRIOR ART
FIG. 1 is a vertical sectional view of a molded case circuit breaker incorporating a trip mechanism having a trip bar.

A typical example of a circuit breaker is disclosed in U.S. Pat. No. 5,341,191, which is herein incorporated by reference. The reference numerals up to and including 140 employed herein are consistent with U.S. Pat. No. 5,341,191. Reference numerals employing "'" (e.g., 20') refer to parts of U.S. Pat. No. 5,341,191 which have been modified. Referring to FIG. 1, a molded case three phase circuit breaker 20 comprises an insulated housing 22, formed from a molded base 24 and a molded cover 26, assembled at a parting line 28, although the principles of the present invention are applicable to various types of electrical switching devices and circuit interrupters.

The circuit breaker 20 also includes at least one pair of separable main contacts 30 per phase, provided within the housing 22, which includes a fixed main contact 32 and a movably mounted main contact 34. The fixed contact 32 is carried by a line side conductor 36, electrically connected to a line side terminal (not shown) for connection to an external circuit or power source (not shown). A movably mounted main contact arm assembly 58 carries the movable contact 34 and is electrically connected to a load conductor 66 by way of a plurality of flexible shunts 70. A free end (not shown) of a load conductor 78 connected to the load conductor 66 acts as a load terminal for connection to an external load, such as a motor (not shown).

Figure 2:
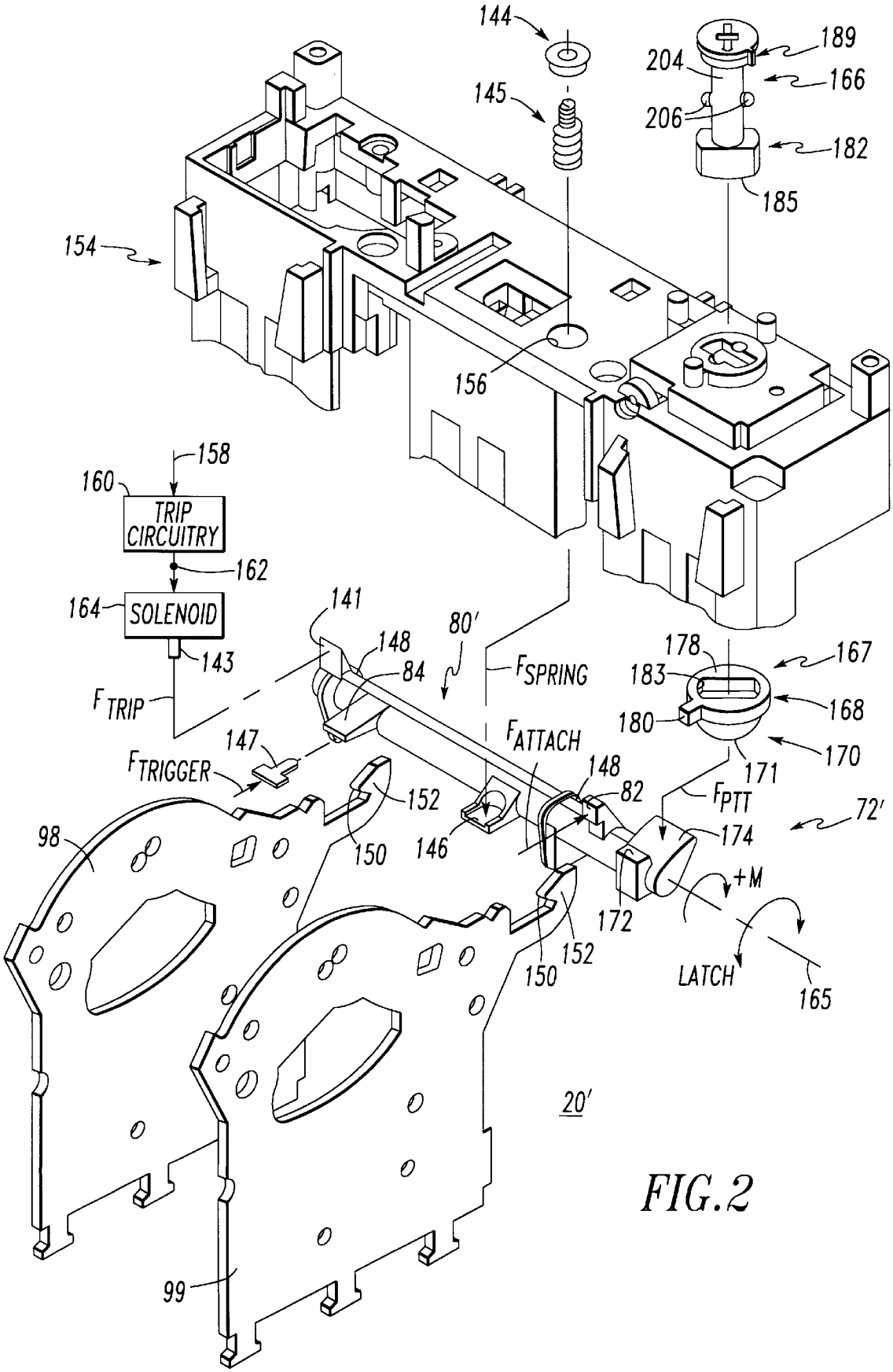
FIG. 2 is an exploded isometric view, in partial block form, of a circuit breaker, with some parts not shown for clarity, including an improved push-to-trip pushbutton, trip bar and interlock cam in accordance with the invention.

An electronic trip unit 72 includes, for each phase, a current transformer (CT) 74 for sensing load current. The CT 74 is disposed about the load conductor 78 and, in a manner well known in the art, detects current flowing through the separable contacts 30 in order to provide a signal to the trip unit 72 to trip the circuit breaker 20 under certain conditions, such as a predetermined overload condition. The trip unit 72 also includes a trip bar 80A and a latch assembly 86. The trip bar 80A has integrally formed extending trip levers 82, 141 (both are shown in FIG. 2). The trip levers 82 and 141, which are respectively mechanically coupled to an undervoltage trip assembly (not shown) and an exemplary solenoid 164 (shown in FIG. 2) within the trip unit 72, facilitate rotation of the trip bar 80A clockwise (with respect to FIG. 1) during predetermined levels of undervoltage and overcurrent, respectively.

The latch assembly 86 latches an operating mechanism 88 during conditions when the circuit breaker 20 is in an on position (shown in solid in FIG. 1) and a non-trip off position (partially shown in phantom line drawing with the arm assembly 58). During an overcurrent condition, the trip unit 72, and more specifically the trip bar 80A, releases the latch assembly 86 to allow the circuit breaker 20 to trip. The exemplary latch assembly 86 includes a reset plate 90, a pivotally mounted lock plate 92, a latch lever trigger assembly 94, and a biasing spring 96, although a wide variety of latch assemblies are possible. The lock plate 92 is pivotally mounted to a pair of spaced apart side plates 98 and 99 (both are shown in FIG. 2), used to carry the operating mechanism 88, by way of a pin 101. The reset plate 90 is coupled to the lock plate 92 at one end. The other end of the lock plate 92 is mounted for arcuate movement within the side plates 98, 99. The lock plate 92 includes a pair of spaced apart notches (not shown) for latching a cradle mechanism 104 which forms a portion of the operating mechanism 88. The biasing spring 96 biases the reset plate 90 and the lock plate 92 counterclockwise (with respect to FIG. 1).

The operating mechanism 88 has a latched position (shown in solid in FIG. 1) provided by the latch assembly 86. Upon clockwise rotation of the trip bar 80A, an insert 147 (shown in FIG. 2) beneath a latch lever 84 (shown in FIG. 2), integrally formed on the trip bar 80A, releases the trigger assembly 94. In turn, the trigger assembly 94 releases the latch assembly lock plate 92 which, in turn, releases the operating mechanism 88 to the unlatched position thereof (partially shown in phantom line drawing in FIG. 1 with the cradle mechanism 104) in order to move the separable contacts 30 to the trip open position thereof, thereby allowing the circuit breaker 20 to trip.

The trigger assembly 94 is pivotally mounted to the two side plates 98, 99 by a pin 100 and is biased in a counterclockwise direction (with respect to FIG. 1) by a torsion spring (not shown). A stop pin 108 serves to limit rotation of the trigger assembly 94. The trigger assembly 94 is integrally formed with an upper latch portion 110 and a lower latch portion 112. The lower latch portion 112 is adapted to engage the lock plate 92. The upper latch portion 110 is adapted to communicate with the trip bar insert 147 (shown in FIG. 2).

The operating mechanism 88 moves the separable main contacts 30 between the closed and open positions thereof and, thus, facilitates opening and closing the separable contacts 30. The operating mechanism 88 includes a toggle assembly 114 which has a pair (only one is shown in FIG. 1) of upper toggle links 116 and a pair (only one is shown in FIG. 1) of lower or trip links 118. Each of the upper toggle links 116 receives a crossbar 126 and is provided with a hole 128A which allows it to be mechanically coupled to the cradle mechanism 104 by way of a pin 130. Operating springs 132 are connected between the crossbar 126 and a handle yoke assembly 134 by way of spring retainers 136.

The cradle mechanism 104 is pivotally connected to the side plates 98, 99 by way of a pin 106. The cradle mechanism 104, in cooperation with the latch assembly 86, allows the circuit breaker 20 to be tripped by way of the trigger assembly 94 of the trip unit 72. In order to reset the cradle mechanism 104, it is necessary to rotate the operating handle 140 toward the off position (shown in phantom line drawing in FIG. 1). The operating handle 140, in cooperation with the handle yoke 134 and a reset pin 142 driven by the yoke 134, allows the cradle mechanism 104 to be moved clockwise (with respect to FIG. 1) and latched relative to the latch assembly 86.

FIG. 2 illustrates an exemplary plastic molded trip bar 80' and an adjustable bias spring mechanism 144 having an adjustable helical compression bias spring 145. The elongated trip bar 80' has a transverse member or paddle 146. The paddle 146 is the point of actuation of the bias spring 145 upon the trip bar 80' which is biased by the spring 145 in the counterclockwise (with respect to FIG. 2) or latch direction. The trip bar 80' also has the insert 147, which is engaged by the latch assembly 86 of FIG. 1, and the trip levers 82, 141, which are engaged by corresponding plungers, such as plunger 143 for trip lever 141, to rotate the trip bar 80' in the clockwise (with respect to FIG. 2) or trip direction to unlatch the latch assembly 86. The exemplary steel latch insert 147 is assembled into a diametrical hole (not shown) in the trip bar 80'. Two recesses 148 retain the trip bar 80' axially in the side plates 98, 99 which provide pivot points 150 for rotation of the trip bar 80' on side plate ears 152. An internal deck or molded housing member 154 of the housing 22 of FIG. 1 has an opening 156 through which the adjustable bias spring mechanism 144 is mounted, although the present invention is applicable to trip bars which do not employ such bias spring mechanism.

The CT 74 of FIG. 1 detects current flowing through the separable contacts 30 and outputs a sensed current value 158 to trip circuitry 160 of a trip unit 72'. The trip circuitry 160 detects an overcurrent condition of the current flowing through the separable contacts 30 and, in response to the sensed current value 158 exceeding a predetermined value, outputs a trip signal 162 to an exemplary magnetic latching solenoid 164. The plunger 143 of the solenoid 164, which responds to the trip signal 162, engages the trip lever 141 and rotates the trip bar 80' clockwise (with respect to FIG. 2) from its latched position to its tripped position, in which the trip bar 80' is disengaged from the latch assembly 86, to release operating mechanism 88.

The trip bar 80', mounted in the trip unit 72', pivots about its longitudinal axis 165 as shown in FIG. 2. The trip bar 80' is normally biased in the counterclockwise latch direction by a spring force, $F_{SPRING}$, which creates a negative moment about the axis 165. During a normal trip sequence, the solenoid 164 is deenergized and the plunger 143 is extended. The plunger 143 generates a force, $F_{TRIP}$, at trip lever 141 which creates a positive moment, +M, about axis 165. The positive moment, +M, rotates the insert 147 of the trip bar 80' away from the latch assembly 86 of FIG. 1, allowing the operating mechanism 88 to trip. Alternatively, another force, $F_{ATTACH}$, at trip lever 82 creates a similar positive moment about axis 165. Furthermore, an actuation portion 185 of the pushbutton 166 (as discussed below in connection with FIG. 3) or a cam surface 171 of an interlock cam 168 (as discussed below in connection with FIG. 4) are also employed to create a similar positive moment about trip bar axis 165.

The housing 22, separable contacts 30, operating mechanism 88, operating handle 140, handle yoke 134, and a trip unit, excluding the trip bar 80' and adjustable mechanism 144, are disclosed in greater detail in U.S. Pat. No. 5,341,191. A replaceable rating plug assembly including a push-to-trip pushbutton and an interlock cam for interfacing a trip bar are disclosed in U.S. Pat. No. 4,603,313, which is also incorporated by reference herein. The present invention provides improvements disclosed herein in connection with a push-to-trip pushbutton 166 and an interlock cam assembly 167 having the interlock cam 168 for interfacing the trip bar 80'.

Figure 5:
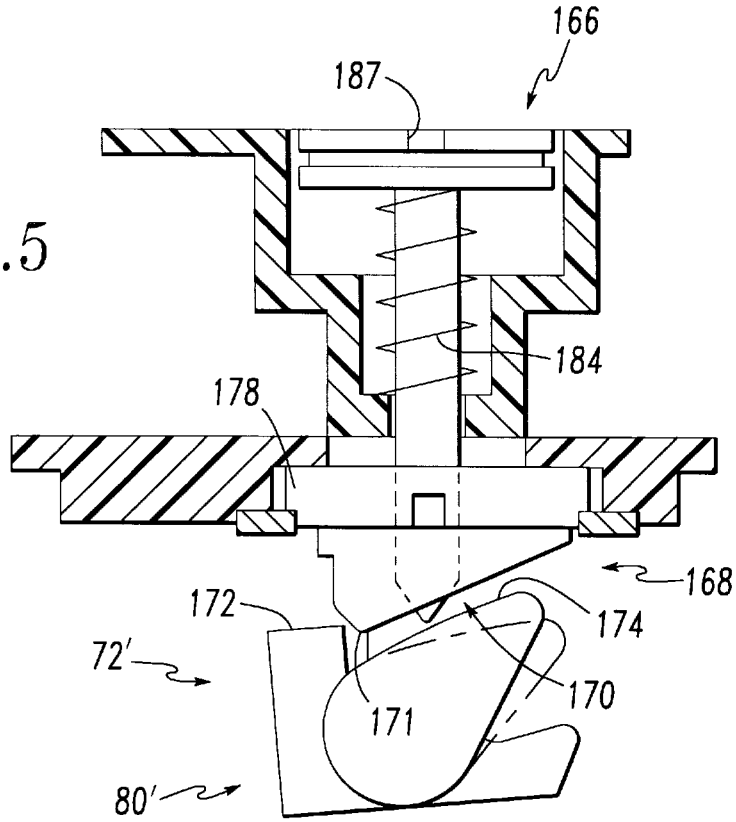
FIG. 5 is a vertical sectional view of the trip bar of FIG. 2 with the pushbutton in an "ENGAGED" position.
Figure 6:
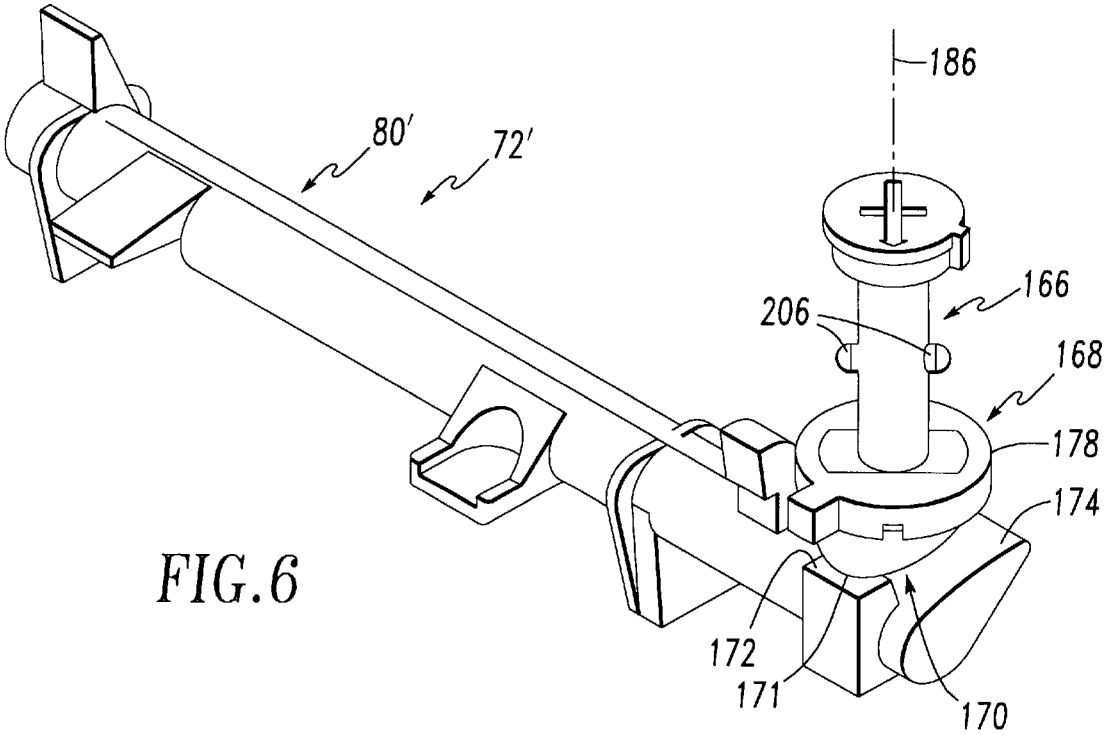
FIG. 6 is an isometric view of the trip bar of FIG. 2 with the pushbutton in a "TRIP LOCK-OUT" position.

The exemplary interlock cam 168 selectively disables the trip unit 72' from tripping the operating mechanism 88. In particular, as discussed below in connection with FIG. 6, the interlock cam 168 selectively prevents the trip bar 80' from rotating to its tripped position by mechanically restraining the trip bar 80' in its latched position. The interlock cam 168 includes a cam lobe 170 having the cam surface 171 which selectively engages (as shown in FIG. 6) and disengages from (as shown in FIG. 5) a trip lock-out surface 172, which is formed on a lever arm cantilevered from the axis 165 of the trip bar 80'. Alternatively, as shown in FIG. 4, the cam lobe 170 on the interlock cam 168 is positioned such that the cam surface 171 engages a trip bar trip lobe 174 and rotates the trip bar 80' from the non-tripped position (shown in phantom in FIG. 4) to the tripped position (shown in solid) thereof.

Figure 3:
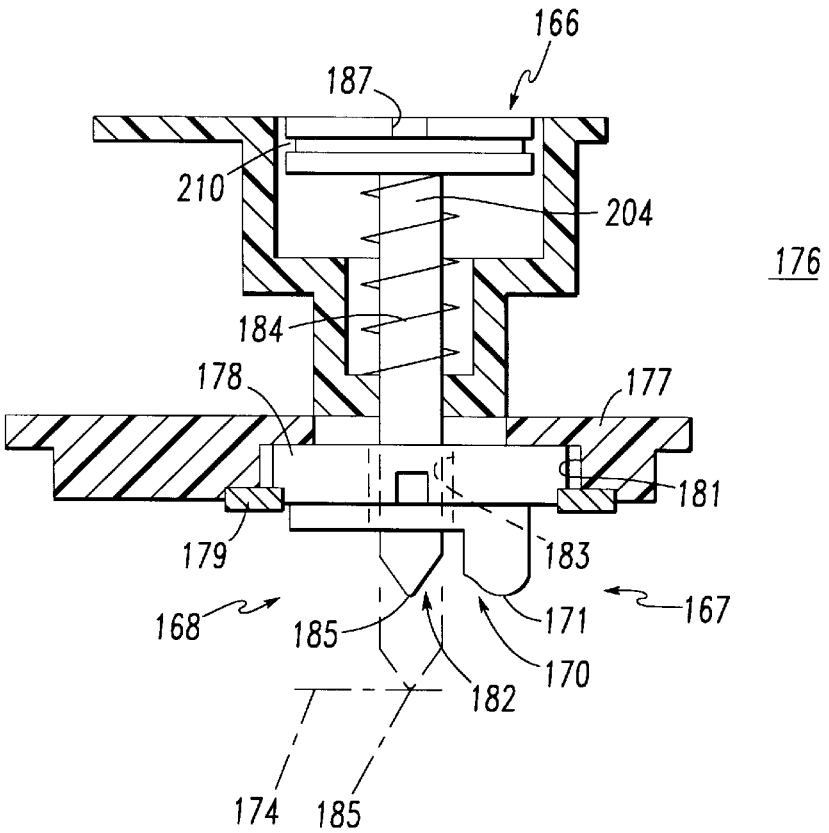
FIG. 3 is a vertical sectional view of a replaceable rating plug assembly, with some parts not shown for clarity, including the push-to-trip pushbutton and interlock cam of FIG. 2.

Referring to FIG. 3, a portion of a replaceable rating plug assembly 176 including pushbutton 166 and interlock cam assembly 167 are illustrated. The interlock cam 168 is mounted in a cam assembly mounting plate 177. A peripheral flange 178 of the interlock cam 168 is seated within a recess of the mounting plate 177 where it is secured by a retaining clip 179. The interlock cam 168 includes a hollow cylindrical portion with the cam lobe 170 formed on the rim thereof.

A tab or radial projection 180 (shown in FIG. 2) extends radially from the flange 178 of the interlock cam 168 and is movable in a 135 degree arcuate portion 181 of the cam assembly mounting plate recess. The arcuate portion 181 permits rotation of the interlock cam 168 by the pushbutton 166. As shown in FIGS. 2 and 3, the pushbutton 166 includes an elongated end portion 182 which is inserted within a corresponding elongated opening 183 of the cam interlock 168 for rotation therewith. As discussed below in connection with FIG. 7, the pushbutton 166 is rotated between three positions to rotate the cam interlock 168 between the three corresponding positions of FIGS. 4–6.

Figure 4:
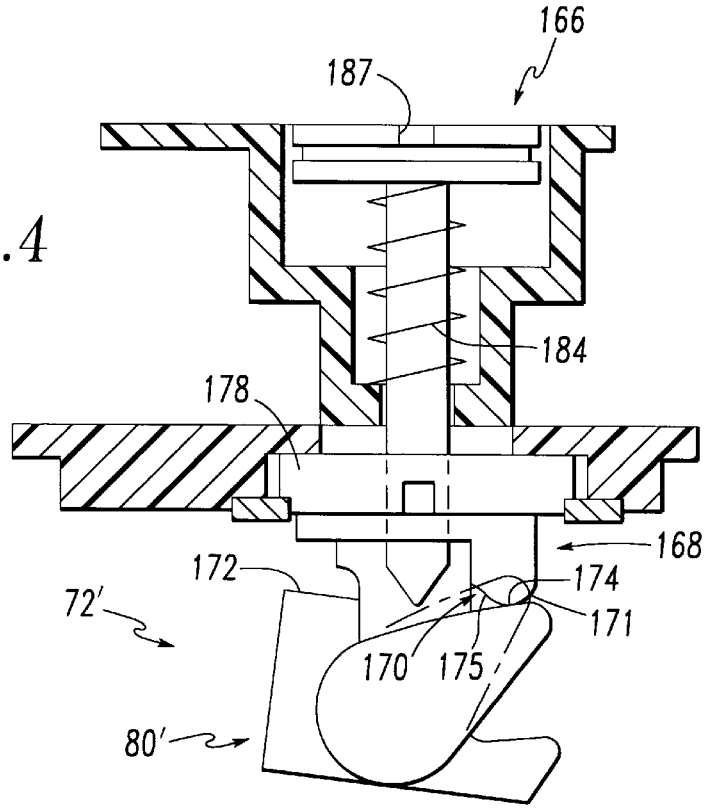
FIG. 4 is a vertical sectional view of the trip bar of FIG. 2 with the pushbutton in a "REMOVE" position.

As shown in FIG. 4, the cam surface 171 of cam lobe 170 is positioned to engage the trip bar trip lobe 174. In this manner, the trip bar 80' is held in its tripped position when the rating plug assembly 176 (shown in FIG. 7) is removed. Therefore, operation of the circuit breaker 20' is prevented when the rating plug assembly 176 is not present.

Referring to FIG. 5, turning pushbutton 166 about 90 degrees clockwise (with respect to FIGS. 2 and 6) from the position of FIG. 4 rotates interlock cam 168 and disengages cam surface 171 of cam lobe 170 from trip lobe 174 and trip bar 80'. A portion 175 (shown in FIG. 4) of the cam surface 171 is recessed in order that the trip lock-out surface 172 of the trip bar 80' does not engage the cam lobe 170 in any of the tripped, non-tripped or latched positions of the trip bar 80'. In this manner, the trip bar 80' may freely move either clockwise to the tripped position (shown in phantom in FIG. 5) to trip circuit breaker 20', or else counterclockwise beyond the non-tripped position (shown in solid) to latch circuit breaker 20' (as discussed above in connection with FIG. 2), thereby permitting conventional trip or latch operation as discussed above in connection with circuit breaker 20 of FIG. 1.

In the rotational position of the pushbutton 166 of FIG. 5, pushing down on such pushbutton with a force, $F_{PTT}$ (shown in FIG. 2), compresses a spring 184 (shown in FIG. 3) and causes the bottom surface or actuation portion 185 of the pushbutton 166 to engage the trip lobe 174 of the trip bar 80' (as shown in phantom line drawing in FIG. 3). This creates a positive moment, similar to the moment, +M, about the axis 165 (shown in FIG. 2) thereby causing release of the latch assembly 86 (shown in FIG. 1) and the tripping of the circuit breaker 20'.

As shown in FIG. 6, in order to cause a "trip lock-out" function, the pushbutton 166 is further rotated about 45 degrees clockwise (with respect to FIGS. 2 and 6) from the position of FIG. 5. This additional rotation of the pushbutton 166 causes the cam surface 171 of cam lobe 170 to engage the trip lock-out surface 172 of the trip bar 80', thereby biasing such trip bar in its latched position. In the position of FIG. 6, the trip bar 80' remains latched regardless of any attempt by the trip unit 72' to rotate the trip bar 80' to cause a trip operation (e.g., by the force $F_{TRIP}$ of FIG. 2), or due to external trip signals of either a shunt trip device (not shown) or an undervoltage release attachment (not shown) (e.g., which provide force $F_{ATTACH}$ of FIG. 2).

Referring to FIG. 7, a plan view of the trip bar 80' and pushbutton 166, as positioned in FIG. 6, is illustrated. A housing 22' of the circuit breaker 20' of FIG. 2 includes a legend (e.g., a rating plug nameplate) for labelling the three rotational positions (shown in FIGS. 4–6) of the pushbutton 166 which rotates about a rotational axis 186 (shown in FIG. 6) between the legend positions: (1) "TRIP LOCK-OUT" (FIG. 6); (2) "ENGAGED" (FIG. 5); and (3) "REMOVE" (FIG. 4). Preferably, the top of the pushbutton 166 includes a slot 187 for insertion of a conventional slotted screwdriver which a user may conveniently employ to rotate the pushbutton 166 between the above-labelled positions and, hence, rotate the cam interlock 168 between the corresponding positions of respective FIGS. 6, 5 and 4. An arrow 188 on the top of the pushbutton 166 preferably points to the selected labeled position on the legend. Although the pushbutton 166 is employed to selectively position the cam interlock 168 in the exemplary embodiment, it will be appreciated that other independent mechanisms may be employed to facilitate this function.

In the first labeled position (FIG. 6), the cam surface 171 of cam lobe 170 engages the trip lock-out surface 172 of the trip bar 80' to restrain such trip bar in its latched position and, thereby, disable the trip unit 72'.

In the second labeled position (FIG. 5), the pushbutton 166 has rotated the cam interlock 168 to a position in which the cam lobe 170 is disengaged from both the trip lock-out surface 172 and the trip lobe 174 of the trip bar 80'. In that rotational position, the pushbutton 166 is movable longitudinally along the rotational axis 186 (FIG. 6) to rotate the trip bar 80' from its latched position to its tripped position.

As shown in FIG. 8, a tab or radial projection 189 extends radially from the upper end of the pushbutton 166 and engages a radial notch or stop 190 in a pushbutton housing 192 which normally limits the rotation of the pushbutton 166 to about 90 degrees between the positions of FIGS. 4 and 5. In the second labeled position (FIG. 5), the arrow 188 points to the legend "ENGAGED" and the pushbutton 166 has rotated the interlock cam 168 to position the cam lobe 170 to be disengaged from the trip lock-out surface 172 and the trip lobe 174 of the trip bar 80' to free such trip bar for normal circuit interruption operation.

Preferably, the tab 189 is frangible and is suitably sized in order that a significant, but realizable, torque is required to break the frangible tab 189 against the stop 190 when rotating the pushbutton 166 from the position of FIG. 5 to the position of FIG. 6. In this manner, it would be more difficult for an operator to accidentally engage the trip lock-out function. Breakage of the tab 189 advantageously provides a visual indication that the circuit breaker 20' has been operated in the trip lock-out mode. It will be appreciated that other equivalent mechanisms, such as, for example, a frangible tab on the interlock cam, or wire seals or padlock arrangements employed in conjunction with a non-breakable tab arrangement, may be used to prevent unauthorized personnel from engaging the trip lock-out function.

In the third labeled position (FIG. 4), the arrow 188 points to the label "REMOVE" and the pushbutton 166 has rotated the cam interlock 168 in order that the cam surface 171 of cam lobe 170 has engaged the trip lobe 174 of the trip bar 80' and rotated such trip bar to its tripped position. In this manner, reconfiguration of the rating plug assembly 176 may be provided in order to redetermine the predetermined rated current or trip value. Preferably, as shown in FIGS. 6 and 4, the cam lobe 170 is employed to respectively disable and trip the trip unit 72' by engaging the trip lock-out surface 172 and the trip lobe 174 of the trip bar 80', respectively.

FIG. 8 is an isometric view of the rating plug assembly 176 employing pushbutton 166 and interlock cam 168 (shown in FIGS. 2 and 3). In order to prevent removal of the assembly 176 from the trip unit 72' while the circuit breaker 20' is in a closed position and to prevent closing of such a circuit breaker from which the assembly 176 has been removed, the assembly 176 is mechanically interlocked with the trip unit 72' and, in particular, the trip bar 80'. Such interlocking between a rating plug assembly and a trip unit, excluding the present "TRIP LOCK-OUT" position, is disclosed in U.S. Pat. Nos. 5,341,191 and 4,603,313, discussed above. U.S. Pat. No. 5,341,191 also discloses a pushbutton, excluding the frangible tab 189, which is similar to the pushbutton 166.

The rating plug assembly 176 also includes a resistor 194 (shown in hidden line drawing) mounted on a printed circuit board (not shown) within the pushbutton or common housing 192, and a plurality of electrical terminals 195 (only one is shown) which allow the assembly 176 to be plugged into the trip unit 72'. Generally, the assembly 176 includes a resistor, such as 194, of a specific resistance for a desired rating. In this manner, the assembly 176 cooperates with the trip unit 72' to determine the predetermined rated current or trip value.

The top surface 196 of the housing 192 has a 90 degree arcuate slot 198 concentric with a cylindrical portion 200. The tab 189 of the pushbutton 166 engages the radial notch or stop 190 at the top (with respect to FIG. 8) of the arcuate slot 198, as shown, in the "ENGAGED" rotational position (FIG. 5). The arcuate slot 198 also defines the "REMOVE" rotational position (FIG. 4), at which the tab 189 engages another radial notch or stop 202 at the bottom of the arcuate slot 198. The shaft portion 204 of pushbutton 166 includes two radial portions 206 which are radially aligned with arcuate ends 208 of the pushbutton end portion 182. The radial portions 206 are oriented parallel to an internal slot (not shown) of the assembly 176 in the "REMOVE" position (FIG. 4), transverse to such slot in the "ENGAGED" position (FIG. 5), and at about a 45 degree angle with respect to such slot in the "TRIP LOCK-OUT" rotational position (FIG. 6). In the "REMOVE" position, as similarly discussed in U.S. Pat. No. 4,603,313, the pushbutton 166 is extended from the housing 192 by the spring 184 (shown in FIG. 3), and a user may grasp the pushbutton 166 by a groove 210 (shown in FIG. 3) to lift the rating plug assembly 176 from the trip unit 72'. In this position, as similarly discussed in U.S. Pat. No. 5,341,191, the radial portions 206 of pushbutton 166 pass through the internal slot of the housing 192. In the latter two positions, the pushbutton 166 is captured relative to the housing 192.

As will be understood by those skilled in the art, the operating handle 140 of FIG. 1 may be employed to move the separable contacts 30 between their closed and open positions independent of the rotational position of the pushbutton 166 and the position of the cam interlock 168 of FIGS. 4–7.

The exemplary cam interlock mechanism prevents an electrical switching apparatus, such as a circuit breaker, from automatically opening during certain emergency conditions. Although the main purpose of the circuit breaker is to trip during overload or short circuit conditions in order to protect downstream equipment and electrical wiring from damage, it may be highly desirable to inhibit the circuit interruption function under certain conditions where, for example, the potential fire hazard of a non-opening circuit breaker is deemed to be a lesser hazard than if current flow to downstream devices is interrupted. The decision to accept the risk of fire over some other hazardous consequence may occur during emergencies or other critical situations where loss of life might occur if power is disrupted. Conceivable situations include, for example, circuit breakers employed in connection with combat (e.g., in a battleship under wartime conditions), fire-fighting (e.g., energizing pumps for pumping water to fire hoses in a high-rise building), spacecraft launch (e.g., energizing ground-based circuits critical to a safe launch), mining (e.g., energizing pumps employed to rapidly remove water from a flooded mine shaft), or nuclear power generation (e.g., energizing circuits critical to tripping a nuclear reactor).

The exemplary interlock mechanism is also advantageous in environments of severe shock and/or vibration in which the relatively sensitive circuit breaker mechanical latching mechanism might release independently of an electronic or thermal-magnetic trip unit. In an electronic trip unit, for example, a device typically used for releasing the operating mechanism latch is a magnetic-latching solenoid. As these devices may be sensitive to strong electromagnetic fields in some circumstances, they might release prematurely or without input from the electronic trip unit. These undesirable occurrences may be obviated by the mechanical interlock mechanism in appropriate circumstances.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical switching apparatus comprising:

a housing;

separable contact means for movement between a closed position and an open position;

operating means for moving said separable contact means between the closed position and the open position thereof, said operating means having a first position and a second position, said second position corresponding to the open position of said separable contact means;

trip means for tripping said operating means to the second position thereof to move said separable contact means to the open position thereof; and means for selectively disabling said trip means from tripping said operating means to the second position thereof.

2. The electrical switching apparatus as recited in claim 1 wherein said trip means includes:

means for sensing a current flowing through said separable contact means and outputting a sensed current value;

latch means for releasing said operating means from the first position to the second position thereof;

trip bar means cooperating with said latch means for rotation between a latched position, in which said trip bar means engages said latch means, and a tripped position, in which said trip bar means is disengaged from said latch means, in order to release said operating means;

means for detecting an overcurrent condition of said current flowing through said separable contact means, in response to said sensed current value exceeding a predetermined value, and outputting a trip signal; and means responsive to said trip signal for rotating said trip bar means from the latched position to the tripped position thereof, with said means for selectively disabling said trip means selectively preventing said trip bar means from rotating to the tripped position thereof.

3. The electrical switching apparatus as recited in claim 2 wherein said trip bar means includes a first surface and a second surface; wherein said trip means further includes rating plug means cooperating with said means for detecting an overcurrent condition to determine said predetermined value; and wherein said means for selectively disabling said trip means includes a cam means for selectively engaging said trip bar means, with said cam means having a cam surface and three positions including:

a first position in which the cam surface engages the first surface of said trip bar means to disable said trip means, a second position in which the cam surface is disengaged from said trip bar means, and a third position in which the cam surface engages the second surface of said trip bar means to rotate said trip bar means to the tripped position thereof.

4. The electrical switching apparatus as recited in claim 2 wherein said trip means further includes:

pushbutton means for rotating said trip bar means from the latched position to the tripped position thereof.

5. The electrical switching apparatus as recited in claim 3 wherein said trip means further includes:

reconfigurable rating plug means cooperating with said means for detecting an overcurrent condition to determine said predetermined value, and pushbutton means for rotating said trip bar means from the latched position to the tripped position thereof, with said pushbutton means having:

a first position which positions said means for selectively disabling said trip means to the first position thereof, a second position which positions said means for selectively disabling said trip means to the second position thereof, and a third position which positions said means for selectively disabling said trip means to the third position thereof to rotate said trip bar means to the tripped position thereof, in order to permit a user to reconfigure said reconfigurable rating plug means to redetermine said predetermined value.

6. The electrical switching apparatus as recited in claim 5 wherein said reconfigurable rating plug means includes a stop; wherein said pushbutton means rotates between the first position, second position and third position thereof; and wherein said pushbutton means includes frangible tab means for engaging the stop of said reconfigurable rating plug means before rotating from one of the second and third positions to the first position of said pushbutton means.

7. The electrical switching apparatus as recited in claim 6 wherein said pushbutton means further includes a rotational axis to rotate between the first position, second position and third position thereof, with said pushbutton means moving longitudinally along the rotational axis to rotate said trip bar means from the latched position to the tripped position thereof.

8. The electrical switching apparatus as recited in claim 1 wherein said trip means includes:

latch means for releasing said operating means from the first position to the second position thereof;

trip bar means cooperating with said latch means for rotation between a latched position, in which said trip bar means engages said latch means, and a tripped position, in which said trip bar means is disengaged from said latch means to release said operating means; and means for rotating said trip bar means from the latched position to the tripped position thereof, with said means for selectively disabling said trip means selectively preventing said trip bar means from rotating to the tripped position thereof.

9. The electrical switching apparatus as recited in claim 8 wherein said means for rotating said trip bar means includes pushbutton means for rotating said trip bar means, with said pushbutton means having a first position which corresponds to said means for selectively disabling said trip means disabling said trip means, and at least a second position otherwise.

10. The electrical switching apparatus as recited in claim 9 wherein said pushbutton means includes means for moving said means for selectively disabling said trip means to selectively disable said trip means; and wherein said means for selectively disabling said trip means includes means for restraining said trip bar means in the latched position thereof in the first position of said pushbutton means.

11. The electrical switching apparatus as recited in claim 10 wherein said trip bar means includes a surface; wherein said means for restraining said trip bar means includes a cam means having a cam surface for selectively engaging the surface of said trip bar means; and wherein said pushbutton means further includes means for rotating said cam means between a first position in which said cam means engages the surface of said trip bar means in the first position of said pushbutton means, and at least a second position in which the surface of said trip bar means is disengaged from the cam surface of said cam means in said at least a second position of said pushbutton means.

12. The electrical switching apparatus as recited in claim 8 wherein said means for selectively disabling said trip means includes means for restraining said trip bar means in the latched position thereof, a first position corresponding to said means for selectively disabling said trip means restraining said trip bar means in the latched position thereof, and at least a second position otherwise.

13. The electrical switching apparatus as recited in claim 12 wherein said trip bar means includes a surface; and wherein said means for restraining said trip bar means includes a cam means for engaging the surface of said trip bar means in the first position of said means for selectively disabling said trip means and for disengaging from the surface of said trip bar means in the second position of said means for selectively disabling said trip means.

14. The electrical switching apparatus as recited in claim 1 wherein said means for selectively disabling said trip means includes a first position in which said means for selectively disabling said trip means disables said trip means and at least a second position otherwise.

15. The electrical switching apparatus as recited in claim 14 wherein said means for selectively disabling said trip means further includes a third position in which said means for selectively disabling said trip means engages said trip means to trip said operating means to the second position thereof.

16. The electrical switching apparatus as recited in claim 1 wherein said operating means includes operating handle means for moving, independent of said means for selectively disabling said trip means, said separable contact means between the closed position and the open position thereof.

17. The electrical switching apparatus as recited in claim 1 wherein said means for selectively disabling said trip means is a mechanical means for selectively disabling said trip means.

18. The electrical switching apparatus as recited in claim 17 wherein said mechanical means is at least substantially within said housing.

19. The electrical switching apparatus as recited in claim 2 wherein said means for selectively disabling said trip means is a mechanical means for selectively preventing said trip bar means from rotating to the tripped position thereof.

20. The electrical switching apparatus as recited in claim 19 wherein said trip bar means includes at least one surface; and wherein said means for selectively disabling said trip means includes a cam means for selectively engaging said trip bar means, with said cam means having a cam surface and at least two positions including:

a first position in which the cam surface engages the surface of said trip bar means to disable said trip means, and a second position in which the cam surface is disengaged from said trip bar means.

21. The electrical switching apparatus as recited in claim 20 wherein said at least one surface of said trip bar means includes a first surface and a second surface; wherein the cam surface engages the first surface of said trip bar means to disable said trip means; and wherein said cam means has three positions including a third position in which the cam surface of said cam means engages the second surface of said trip bar means to rotate said trip bar means to the tripped position thereof.

* * * * *